US011918037B2

(12) United States Patent
Fischer

(10) Patent No.: US 11,918,037 B2
(45) Date of Patent: Mar. 5, 2024

(54) SMOKING DEVICE

(71) Applicant: Steve Fischer, Hartland, WI (US)

(72) Inventor: Steve Fischer, Hartland, WI (US)

( * ) Notice: Subject to any disclaimer, the term of this patent is extended or adjusted under 35 U.S.C. 154(b) by 832 days.

(21) Appl. No.: 16/782,496

(22) Filed: Feb. 5, 2020

(65) Prior Publication Data

US 2021/0235749 A1 Aug. 5, 2021

(51) Int. Cl.
*A24F 1/00* (2006.01)
*A24F 5/08* (2006.01)
*A24F 5/10* (2006.01)

(52) U.S. Cl.
CPC ..... *A24F 1/00* (2013.01); *A24F 5/08* (2013.01); *A24F 5/10* (2013.01)

(58) Field of Classification Search
CPC ..... A24F 1/00; A24F 1/06; A24F 3/00; A24F 5/00; A24F 5/08; A24F 5/10
See application file for complete search history.

(56) References Cited

U.S. PATENT DOCUMENTS

2016/0135498 A1* 5/2016 DesCamp ..... A24F 5/00 131/330
2018/0228211 A1* 8/2018 Eckhoff et al. ..... A24F 5/10

FOREIGN PATENT DOCUMENTS

GB 2 299 012 * 9/1996 ..... A24F 1/00

* cited by examiner

*Primary Examiner* — Dionne W. Mayes
(74) *Attorney, Agent, or Firm* — Boyle Fredrickson, SC

(57) ABSTRACT

A reusable multiple dose smoking appliance includes a cover and a base that removeably cooperate with a receptacle. The receptacle defines at least one reservoir configured to contain a volume of a smokeable media and at least one primary smoke channel. Cooperation of the base and receptacle define a secondary smoke channel that is in fluid communication with the primary smoke channel. An aperture is defined by the cover and is oriented to selectively expose and obstruct the smokeable content reservoir. When the reservoir is exposed to atmosphere and a combustion source is disposed proximate thereto, user inhalation effectuates combustion of the smokeable media such that the fire effluent or smoke is communicated to the user via the primary and secondary smoke channels.

18 Claims, 12 Drawing Sheets

SMOKING DEVICE

FIELD OF INVENTION

The present invention relates generally to a smoke dispenser and, more particularly, to a smoke dispenser assembly with refillable or replaceable combustible media and that is constructed to rotatably open to dispense smoke via environmental flow streams through a housing of the smoke dispenser assembly.

BACKGROUND OF THE INVENTION

Personal smoking dispensers are well known and are most commonly used with cigarettes. Cigarettes may be placed within a chamber of the smoking dispenser, where a lever or button is pressed to dispense a cigarette. While conventional smoking dispensers may be used with media, such as tobacco or *cannabis*, the smokeable leaves must already be rolled into joints before being stored or stowable within a personal smoking dispenser. Various types of smokeable media may instead be used in a single or limited dose configuration, colloquially referred to as a one-hitter device, such as a slender pipe with a screened narrow bowl, designed for a single or limited number of inhalations or "hits" of smoke and/or vaper associated with the burnable media. Still other devices, such as pipes or the like, require consumption of the entirety of the smokeable media or discarding of unburned media when smoking is no longer desired or extinguishment of any unconsumed smokeable media prior to storage of the smoking appliance in a non-combusting manner.

Such systems can require convoluted and complicated manipulation of media containers and/or components thereof relative to the underlying dispenser assemblies to achieve the intended operation of the dispenser assembly. Some such systems may require a case to prevent the breakage of the dispenser assembly. Such systems may further require introduction of the treatment or smokeable media to a dispenser supported reservoir in a manner that can lead to spillage or spoilage of the smokeable media prior to use or consumption. Still others require replenishment of the media from bulk containers that commonly require storage and/or repeated transport of previously opened bulk containers. Such approaches can result in spillage of the media. Further, such systems commonly require the media container to be filled with smokeable media each time use is desired. Such approaches can also result in waiting before the smokeable media device can be prepared for subsequent use or operation.

Therefore, the need exists for a smoking device or smoke dispenser assembly that is sturdy, easy to use, prevents waste and spoilage of media, and is constructed to support multiple doses of smoking media in a ready-to-use configuration. There is a further need for a smoking device that is constructed to extinguish any smoldering of discrete doses of smokeable media if it is desired to terminate the smoking activity terminates before consumption of an discrete dose of smoking media. There is a further need for a smoking device that is constructed to provide on-board storage of additional stores of smoking media and in a manner that maintains the quality of the smoking media and maintains isolation of the stowed smoking media and the combustion and consumption paths associated with consumption of any discrete dose supported thereby.

SUMMARY OF THE INVENTION

The present invention relates generally to a smoke dispenser and, more particularly, to a smoke dispenser assembly with replaceable media that is constructed rotatable open to dispense smoke via environmental flow streams through a housing of the smoke dispenser assembly. The present invention discloses a smoke dispenser assembly that solves one or more of the shortcomings disclosed above.

One aspect of the present invention includes a cover, a receptacle, and a base. The cover and base being selectively engageable with the receptacle located in between. The cover can selectively rotate allowing the user access to media stored within a series of combustion apertures located in the receptacle. It is appreciated that the media may safely be stored within the series of combustion apertures until such time of use is desired. It is further appreciated that series of combustion apertures may be refilled with additional media.

Another aspect of the invention that is usable or combinable with the above aspects, objects, and features discloses the smoke dispenser assembly having at least one primary smoke channel extending through a receptacle sidewall to a secondary smoke channel, which is further in fluid communication with at least one combustion aperture.

A further aspect of the present application that is usable or combinable with one or more of the above features, aspects, and objects discloses a storage cavity located and positioned in the receptacle. When the base of the smoke dispenser assembly selectively engages with the cover, the base platform is adjacent to and abuts the receptacle lip thereby forming the storage cavity. It is appreciated that the storage cavity may be used to store media within to prevent waste and spoilage.

Another aspect of the application that is combinable or usable with one or more of the above aspects, features, and objects discloses a method of cleaning the combustion aperture after consuming media. The method includes associating a flame with a screen of the combustion aperture and holding the flame there until the residue from media consumption has been incinerated.

These and other aspects, features, and advantages of the present invention will become apparent from the detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
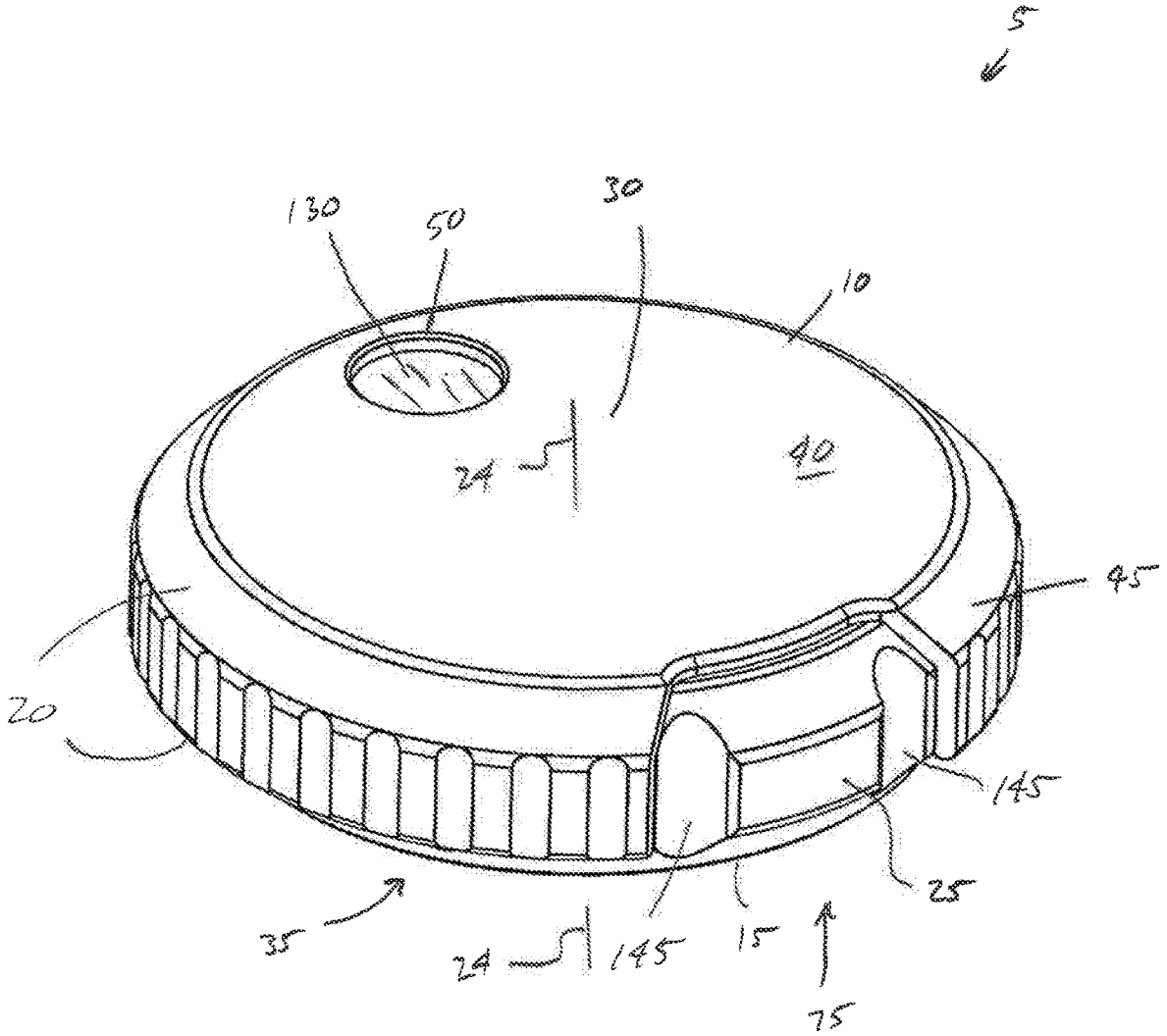
FIG. 1 is a top perspective view of a smoke dispenser assembly according to the present invention with the assembly in a stowed or closed configuration.

In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. The various features and advantageous details of the subject matter disclosed herein are explained more fully with reference to the non-limiting embodiments described in detail in the following description.

Illustrative components of a multiple dose smoking appliance, smoking device, smoke delivery system or assembly 5 in accordance with various aspects of the present invention are shown in FIG. 1 through FIG. 12. Referring to FIG. 1, smoke delivery assembly 5 is generally disk shaped and is rotatable in a manner disclosed below such that smoke delivery assembly 5 is operable to achieve a plurality of discrete "closed" positions or orientations and a plurality of discrete "open" or usable configurations that are each associated with combustion of discrete doses of combustible or smokeable media 171 (FIG. 7) disposed in a plurality of discrete combustion chambers as disclosed further below. Referring back to FIG. 1, smoke delivery assembly 5 generally defines a first end 10 and a second end 15 that are disposed at generally opposite axial ends of assembly 5 associated with opposite sides of assembly 5 and a radially outward oriented side that extends between imaginary planes coincident with the respective first and second ends 10, 15. A one or multiple component enclosure or housing 20 generally defines and extends across first end 10 of assembly 5 and a cartridge, cylinder, or receptacle 25 is located generally adjacent housing 20 and, as disclosed further below, is rotatable relative thereto about an axis of rotation, indicated by line 24 to allow selective access to discrete charges of a smokeable media.

When assembled, receptacle 25 is generally rotationally captured between housing 20 and a base 35 associated with second end 15 of assembly 5. As disclosed above, cover 30 is associated with the first end 10 of assembly 5 and includes a skirt or a sidewall 45 that extends in direction generally aligned with axis 24 and toward second end 15 of smoke delivery assembly 5 such that, when assembled, a portion of radially outward facing edge of receptacle 25 is radially bounded by sidewall 45. Base 35 is associated with the second end 15 of assembly 5 and removeably attached to cover 30. Receptacle 25, cover 30, and base 35 cooperate with one another such that, when assembled, receptacle 25 is rotatable relative to cover 30 and base 35 whereas cover 30 and base 35 are preferably maintained in the same rotational orientation relative to one another until disassembly, cleaning, or reloading of assembly 5 is desired as disclosed further below. Cover 30 and base 35 preferably selectively engage one other, with the receptacle 25 located therebetween, to allow selective exposure and consumption of discrete doses of a smokeable media disposed within assembly 5.

Figure 2:
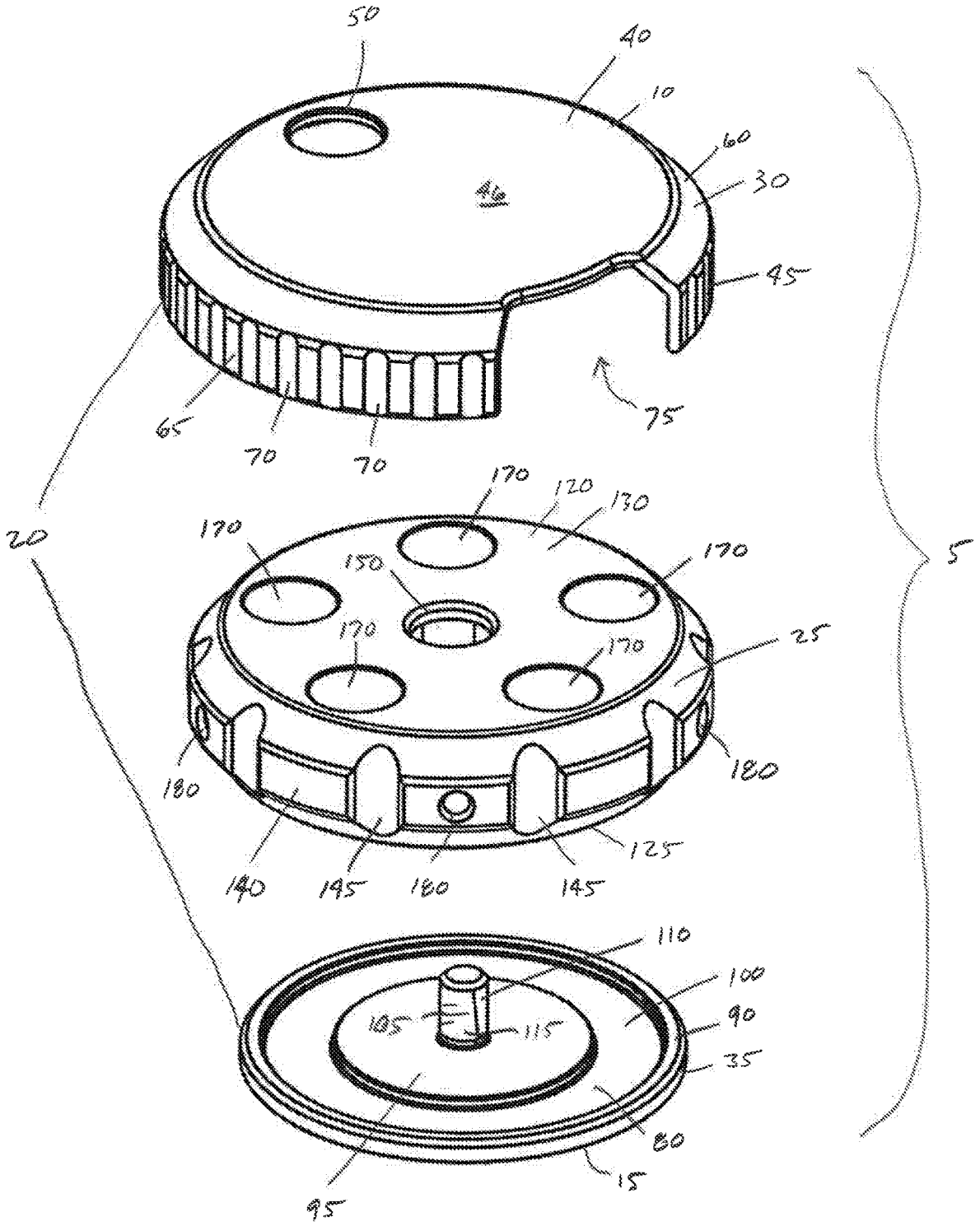
FIG. 2 is a top exploded perspective view of the smoke dispenser assembly of FIG. 1.
Figure 3:
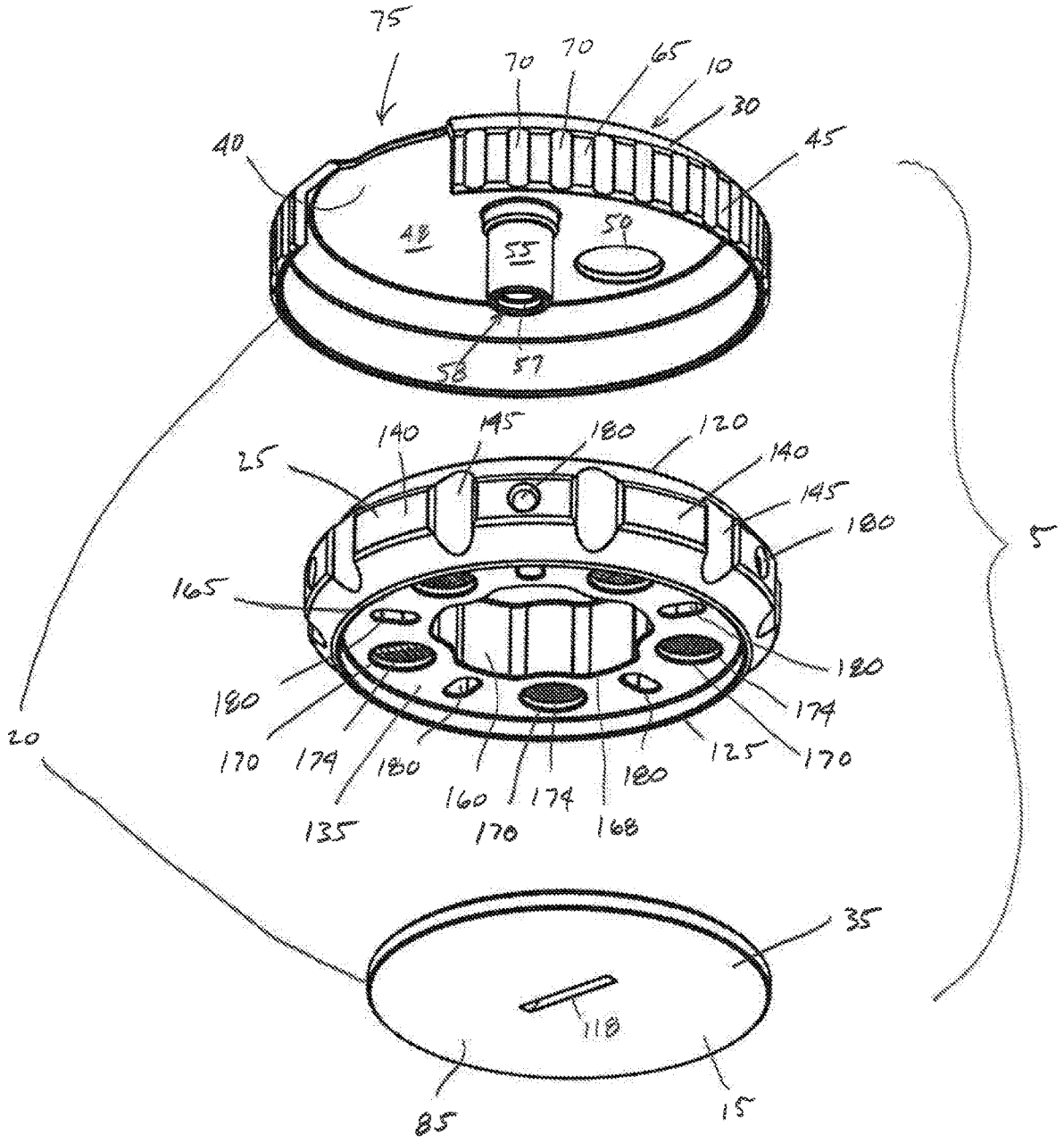
FIG. 3 is a bottom exploded perspective view of the smoke dispenser assembly of FIGS. 1 and 2.

Turning to FIGS. 2 and 3, a surface or face 40 is defined by cover 30 and is generally bounded by sidewall 45. Cover face 40 has a generally planar circular shape and includes an atmosphere facing cover surface 46 and a receptacle facing bottom cover surface 48. Cover surface 46 extends along the first end 10 of smoke delivery assembly 5, while receptacle facing surface 48 of cover 30 is oriented opposite thereto. An opening, hole, or aperture 50 extends through cover face 40 and is oriented to be selectively aligned with discrete chambers containing a smokeable media and/or with a cover facing surface 130 of receptacle 25 during non-use or stowage of assembly 5. A stem or tube 55 (FIG. 3) extends in an axial direction from receptacle facing surface 48 of cover 30. Tube 55 has a generally cylindrical shape and is constructed to pass in an axial direction through at least a portion of receptacle 25. Tube 55 is preferably centrally oriented relative to cover face 40 and extends from bottom cover surface 48 toward second end 15 of assembly 5. Although various methodologies are envisioned, in one embodiment, a series of threads 57 are defined by an inner surface 58 of tube 55 and are constructed to cooperate with an externally threaded structure, such as a fastener or the like, to secure base 35 relative to cover 30 with receptacle 25 disposed therebetween. It is appreciated that other operative engagements may be provided, such as a snap fit methodology, constructing the cover and base such that a removable fastener approaches from the direction of the cover, securing associations that are radially offset from axis of rotation between cover 30 and receptacle 25, etc.

In a preferred embodiment, cover 30 includes a cover sidewall shoulder section 60 and a cover sidewall grip section 65 that are oriented along sidewall 45 as sidewall 45 progresses away from first end 10 toward second end 15 of assembly 5. Shoulder section 60 extends from cover face 40 towards the second end 15 at an approximate 45° angle plus or minus 10°. Grip section 65 extends from the shoulder section 60 towards the second end 15 of assembly 5 at an approximate 135° angle plus or minus 10° such that sidewall grip section 65 extends at an angle that is generally perpendicular to the cover face 40, preferably perpendicular thereto, preferably aligned with an axis 24 associated with rotation of cover 30 relative to receptacle 25, and/or defines an outward radial surface of assembly 5. In alternative embodiments, the cover 30 may not include the cover sidewall shoulder section 60. In yet another embodiment, either or both the cover sidewall shoulder section 60 and cover sidewall grip section 65 may extend at different angles than those provided above, relative to one another, and/or relative to the axis of rotation between cover 30 and receptacle 25. The cover sidewall grip section 65 may further include a series of grip channels 70 that extend along the cover sidewall grip section 65 from the first end 10 of smoke delivery assembly 5 towards the second end 15 of smoke delivery assembly 5. In other embodiments, the cover sidewall grip section 65 may be substantially smooth or may include an alternate textured pattern. Texturing of grip section 65 improves the tactile interface and facilitates more convenient rotation of cover 30 relative to receptacle 25 during use of assembly 5.

Cover 30 includes a cutout or an opening or open section 75 that is preferably formed in at least one and a limited circumferential portion of one or both of shoulder section 60 and/or sidewall grip section 65 of sidewall 45. Open section 75 extends in a generally radial direction through the respective radial portion of sidewall 45 of cover 30 and allows direct user interaction with receptacle 25 while the user interacts with one or both of cover 30 and base 35. As disclosed further below, concurrent user interaction with receptacle 25 and at least one of cover 30 and/or base 35 allows the user, preferably in a single handed manner, to rotate cover 30 relative to receptacle 25 to allow selective interaction with a discrete dose of smokeable media supported by assembly 5.

Like cover 30, base 35 includes a receptacle facing surface 80 and an atmosphere facing surface 85 generally opposite thereto and which are generally aligned with the imaginary plane defined by second end 15 of assembly 5. Referring to FIG. 2, base 35 includes a base sidewall 90 that extends about at least a portion of the circumference of base 35 and from receptacle facing surface 85 or toward first end 10 of smoke delivery assembly 5. Sidewall 90 generally circumscribes the circumference of receptacle facing surface 85 and is oriented to cooperate with a groove defined by a base facing side of receptacle 25 as disclosed further below. Receptacle facing surface 80 includes a base platform 95 that is generally positioned proximate the center of the receptacle facing surface 80. Although other shapes are envisioned, platform 95 of base 35 projects toward first end 10 of assembly 5 and is generally bounded by a channel 100 that extends thereabout and is disposed between platform 95 and sidewall 90. As disclosed further below, during smoking operations, channel 100 defines a portion of the smoke path between each discrete charge of smoking media and draw passage that is constructed to be associated with the user.

A base insert or projection 105 extends from base 35 toward first end 10 of assembly 5. Projection 105 extends away from base platform 95 and includes a plurality of or series of threads 110 which extend in an outward radial direction from an outer surface 115 of the projection 105. Projection 105 and threads 110 are located and positioned so that protection 105 operatively engages tube 55 defined by cover 30, and the threads 57 defined thereby, when cover 30 and base 35 are engaged with one another and when receptacle 25 is disposed therebetween. It is further appreciated that the operability of projection 105 and threads 110, and the cooperation thereof with cover 30, may be provided as a fastener constructed to pass through base 35 and in a manner that provides the selectively severable connection and disconnection of cover 30 and base 35 and the selective access to receptacle 25. Referring to FIG. 3, the atmosphere facing surface 85 of base 35 preferably includes a slot 118 or the like associated with facilitating the relative rotational association of cover 30 and base 35 to effectuate the threadable interaction therebetween. It is appreciated that the shape of slot 118 may be provided in sizes and shapes other than that which is shown.

Figure 4:
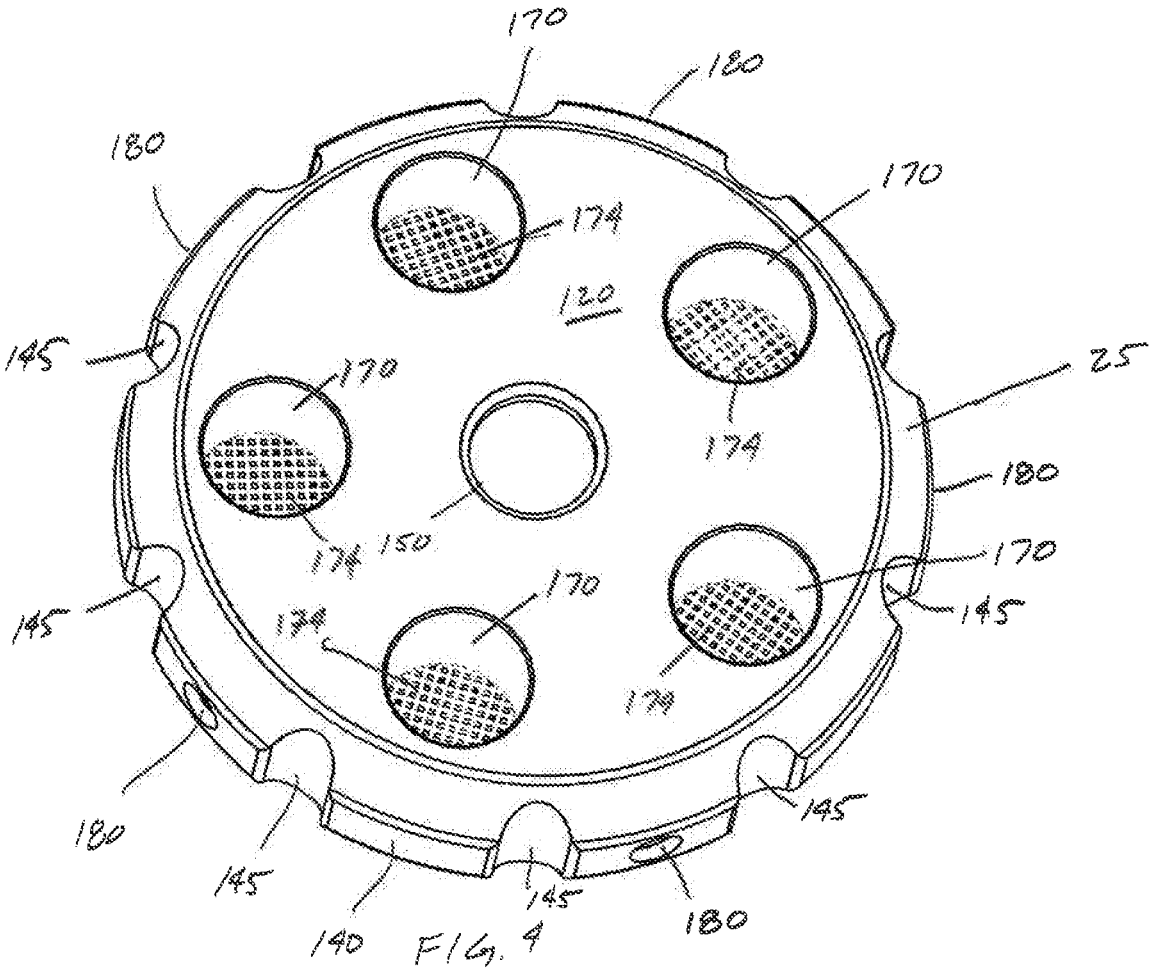
FIG. 4 is a top perspective view of a receptacle of the smoke dispenser assembly shown in FIG. 1.

As disclosed above, receptacle 25 of assembly 5 is located and positioned between cover 30 and base 35 when cover 30 and base 35 are selectively engaged therewith. Referring to FIGS. 2-4, receptacle 25 includes a cover facing surface or first receptacle end 120 and a base facing surface or second receptacle end 125. Receptacle 25 has a generally circular disk shape that extends axially between a top receptacle face 130, a bottom receptacle face 135 and include a receptacle sidewall 140 oriented at an outward radially edge thereof and which extends between the top receptacle face 130 and bottom receptacle face 135. Receptacle 25 further includes a series of respective grooves 145 that are spaced apart from each other, extend in an axial direction generally aligned with the axis of rotation of cover 30 and base 35 relative to receptacle 25 and are formed on the receptacle sidewall 140. Each receptacle groove 145 defines an indention or channel that preferably extends from the first receptacle end 120 towards the second receptacle end 125. In alternative embodiments, the receptacle 25 may not include receptacle grooves 145 or the receptacle grooves 145 may be formed in shapes other than those shown. It is further appreciated that grooves 145 may have different sizes and shapes relative to one another as grooves 145 extend about the radially outward directed circumferential surface of receptacle 25. Receptacle 25 further includes a receptacle channel 150 that is located and positioned proximate the center of the receptacle 25 preferably extends from the first receptacle end 120 and a second receptacle end 125. Channel 150 is shaped to accommodate without interfering with the threadable connection between cover 30 and base 35 as disclosed above.

Receptacle 25 further includes a cavity or receptacle cavity 155 and a media storage cavity 160. The receptacle cavity 155 is located and positioned on the bottom receptacle face 135 and extends towards the top receptacle face 130. The receptacle cavity 155 forms a receptacle rim 165 that extends about a portion of, and preferably the entirety of, a circumference of receptacle cavity 155. The storage cavity 160 is located radially and axially inboard of the receptacle cavity 155 and extends a greater degree toward the top receptacle face 130 than receptacle cavity 155. Base 35 is shaped to be generally bounded by rim 165 and traverse the larger open end defined by storage cavity 160 when cover 30 and base 35 are engaged with receptacle 25. Receptacle 25 forms a receptacle lip 168 that bounds the storage cavity 160 and provides a support that extends in a radially direction along a portion of base 35 when base 35 is engaged therewith. Such a construction allows storage of supplemental or ancillary smoking media within storage cavity 160 in a manner wherein the supplemental smoking media is protected from spoilage and isolated from the flow passages associated with use of assembly 5 rendering onboard stored media readily available for subsequent consumption with assembly 5 as disclosed further below.

Figure 5:
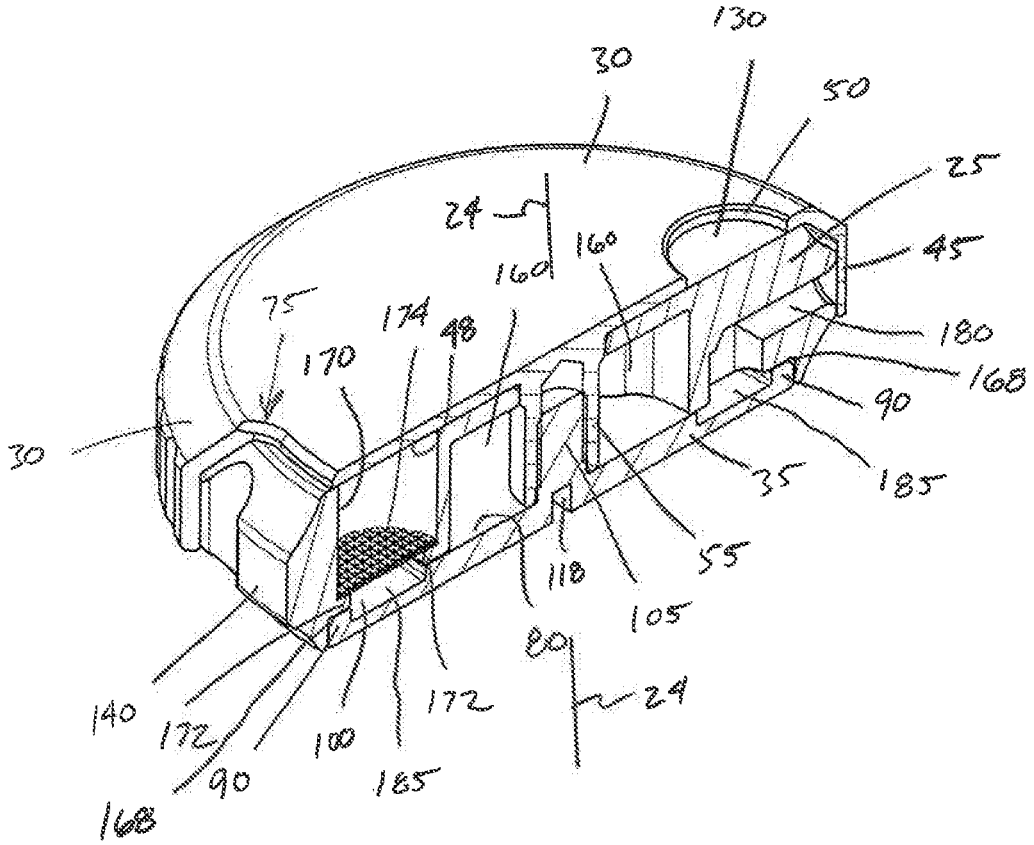
FIG. 5 is a perspective cross section view of the smoke dispenser assembly shown in FIGS. 1-3 in a closed configuration and taken along a radial centerline thereof.

Referring to FIGS. 4 and 5, receptacle 25 defines at least one and preferably a plurality of or series of combustion or media containing reservoirs, chambers, or apertures 170 that extend between top receptacle face 130 and the opposing side of receptacle 25 facing towards receptacle lip 168. Each combustion aperture 170 defines a volume associated with containing a volume of smokeable media 171 (FIG. 7) and the forming a series of channels that extend in an axial direction through receptacle 25. Referring to FIGS. 2-5, although the embodiment of assembly 5 shown in the drawings includes five (5) discrete combustion apertures 170, it is appreciated that other numbers of discrete combustion apertures are envisioned and within the scope of the appending claims. For instance, it is appreciated that the diameter and/or thickness or depth of assembly 5, and/or the relative size of the discrete doses of smoking media intended to be made available for each discrete smoking activity, can be provided in various sizes, shapes, and/or spaced relationships to provide an assembly having numbers of discrete combustion chambers other than that shown in the figures.

It is appreciated that a thicker or "taller" assembly 5, or a larger diameter assembly 5, may allow the radius and/or shape of apertures 170 to be manipulated such that other numbers of apertures or chambers may be provided and oriented to extend in a circumferential manner about assembly 5 and to provide a desired dose of a discrete smokeable media associated therewith.

Regardless of the relative number of discrete combustion chambers or apertures 170 provided, each combustion aperture 170 preferably incudes a combustion aperture rim 172 (FIG. 5) that extends about at least a portion of an inner surface 175 of each discrete combustion aperture 170 proximate base 35. As a result, the combustion aperture 170 has a larger diameter proximate end 10 of assembly 5 than the diameter at the second smoke delivery assembly end 15. The combustion aperture rim 172 is configured to support a screen 174 placed within each discrete combustion aperture 170. Screen 174 mitigates passage of non-combusted media into the volume defined by the overlapping cooperation of channel 100 of base 35 with the discrete apertures 170 defined by receptacle 25. It is appreciated that screen 174 could alternatively be provided to have a generally disk shape and be constructed to be captured between base 35 and receptacle 25. Regardless of its relative location, screen 174 is preferably supported by one of receptacle 25 and base 35 to mitigate loss of the same and/or to mitigate detraction of the convenience associated with user interaction with assembly 5.

Receptacle 25 further includes a plurality of primary smoke channels 180 that are each preferably fluidly connected to the volume associated with channel 100 defined by cooperation of receptacle 25 and base 35. Each primary smoke channel 180 is spaced circumferentially apart from each other smoke channel 180 and is formed to extend, at least in part, in a radial direction through sidewall 140 of receptacle 25 between adjacent combustion apertures 170 such that a terminal end of each smoke channel 180 emerges or is otherwise accessible proximate the outward radial edge of receptacle 25 proximate receptacle lip 168. The terminal end of the plurality of discrete smoke channels 180 are oriented in a spaced manner about the circumference of receptacle 25 of assembly 5 and oriented such that only one smoke channel 180 is exposed to atmosphere or otherwise accessible to the user at any given time when assembly 5 is configured for use as a smoke delivery device and such that the fluid connectivity of each of the remaining smoke channels 180 is obscured or otherwise obstructed by the overlapping cooperation of skirt or sidewall 45 of cover 30 with the outward radially oriented surface of receptacle 25.

Figure 6:
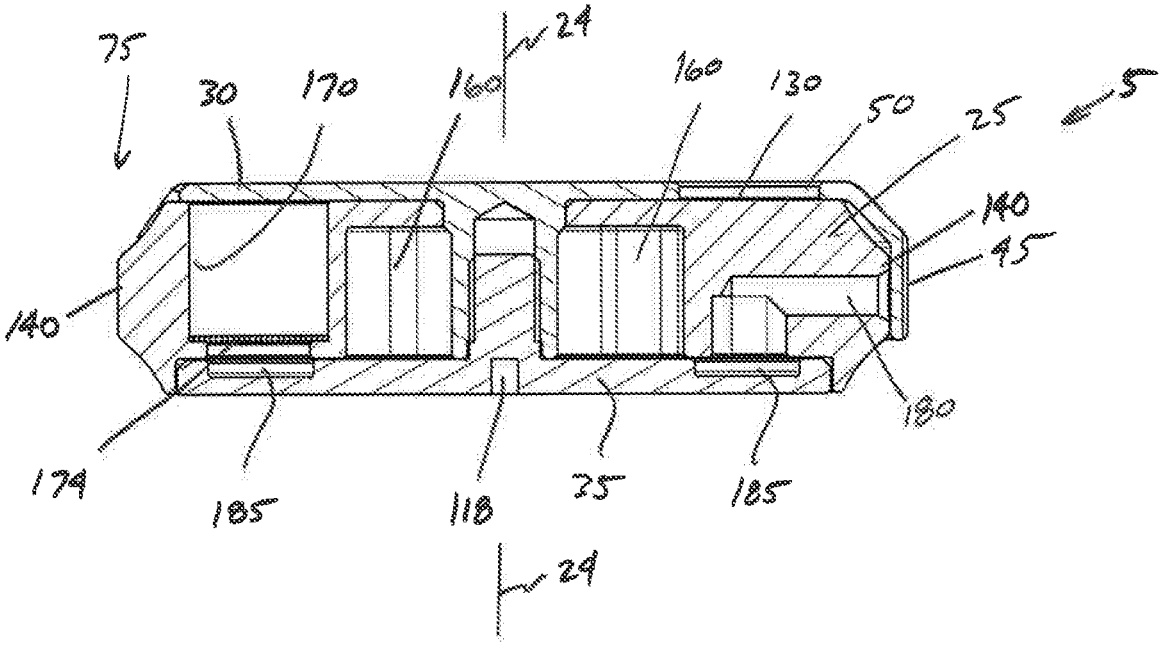
FIG. 6 is an elevation view of the cross section of the smoke dispenser assembly shown in FIGS. 1-3 when oriented in a closed configuration.
Figure 7:
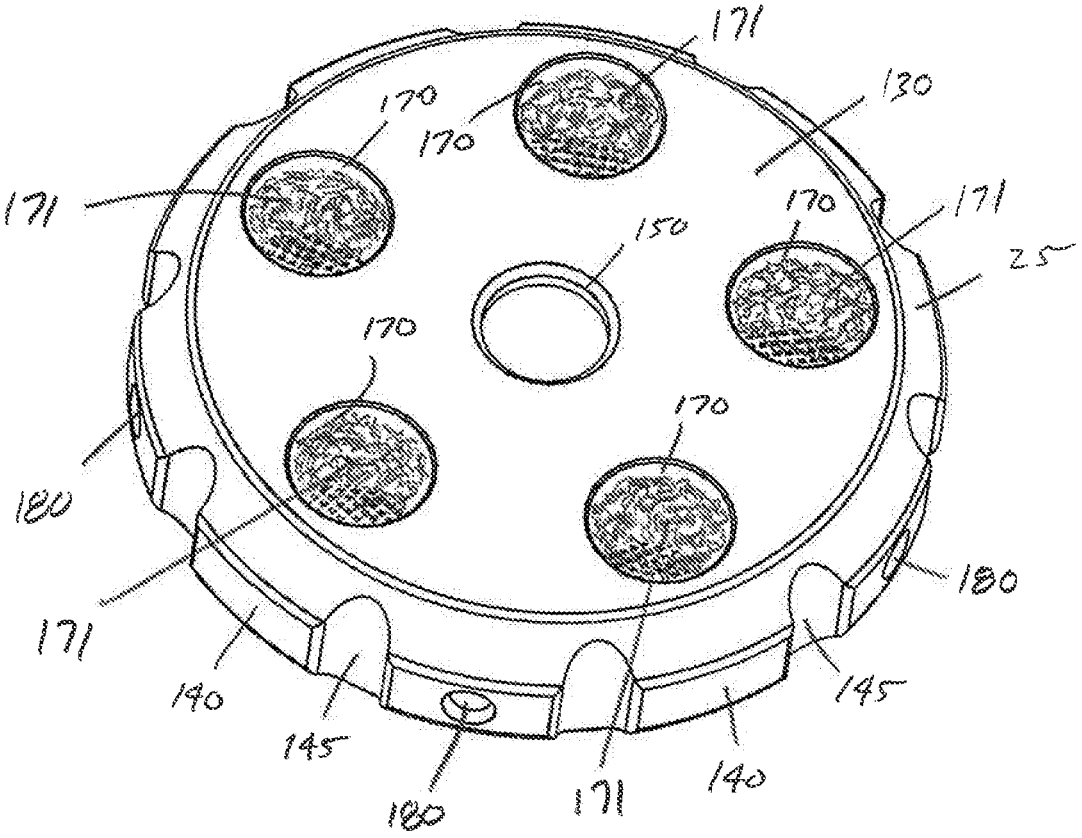
FIG. 7 is a top perspective view of the receptacle of the smoke dispenser assembly shown in FIGS. 1-3 and having a plurality of doses of a smokeable media associated with each of the plurality dose chambers thereof.

Referring to FIGS. 5-7, during assembly of smoke dispenser assembly 5, the receptacle 25 is positioned proximate the base 35 so that the bottom receptacle face 135 is adjacent to and abuts receptacle facing base surface 80 and base projection 105 extends through the receptacle channel 150. Cover 30 is associated proximate receptacle 25 and base 35 such that top receptacle face 130 abuts the bottom cover surface 48 and tube 55 extends toward or through the receptacle channel 150. The tube 55 of the cover 30 is aligned with the projection 105 of the base 35 such that, relative rotation between cover 30 and base 35 allows tube 55 and the base projection 105 to operatively engage one another via the threaded engagement associated therewith such that receptacle 25 is located inside housing 20 defined by the cooperation of cover 30 and base 35. As alluded to above, it is appreciated that housing 20 may be formed through a snap-fit engagement, a friction engagement, or other types of engagements suitable for securing structures relative to one another and in a manner that accommodates rotational association with otherwise relatively non-secured structures such as rotational fasteners such as the cooperation of threaded interfaces or the like.

When cover 30 and base 35 are selectively engaged with one another to form the housing 20 with the receptacle 25 located generally within the housing 20, the base sidewall 90 is disposed generally adjacent to and preferably abuts the receptacle lip 168, while the base platform 95 is disposed generally adjacent to and preferably abuts the receptacle lip 168. The base sidewall 90, the base platform 95, and the receptable lip 168 form a plenum or secondary vapor or smoke channel 185 within the smoke dispenser assembly 5. The secondary smoke channel 185 includes the base channel 100 and is further fluidly connectable to each of the combustion apertures 170 and the primary smoke channels 180. It should be appreciated that smoke channel 185 can be fluidly connected to each combustion aperture either concurrently or discretely. As disclosed further below, whether collectively or discretely fluidly connected to apertures 170, during use of smoking assembly 5, and during combustion of the contents of a discrete aperture 170, ambient airflow can be drawn via user inhalation associated with interaction with a respective primary smoke channels 180 that is rotational aligned with cutout 75, through a respective exposed combustion aperture 170 (and the smoking media associated therewith), and communicated between the discrete combustion aperture 170 and the respective primary smoke channel 180 via secondary smoke channel 185.

Figure 8:
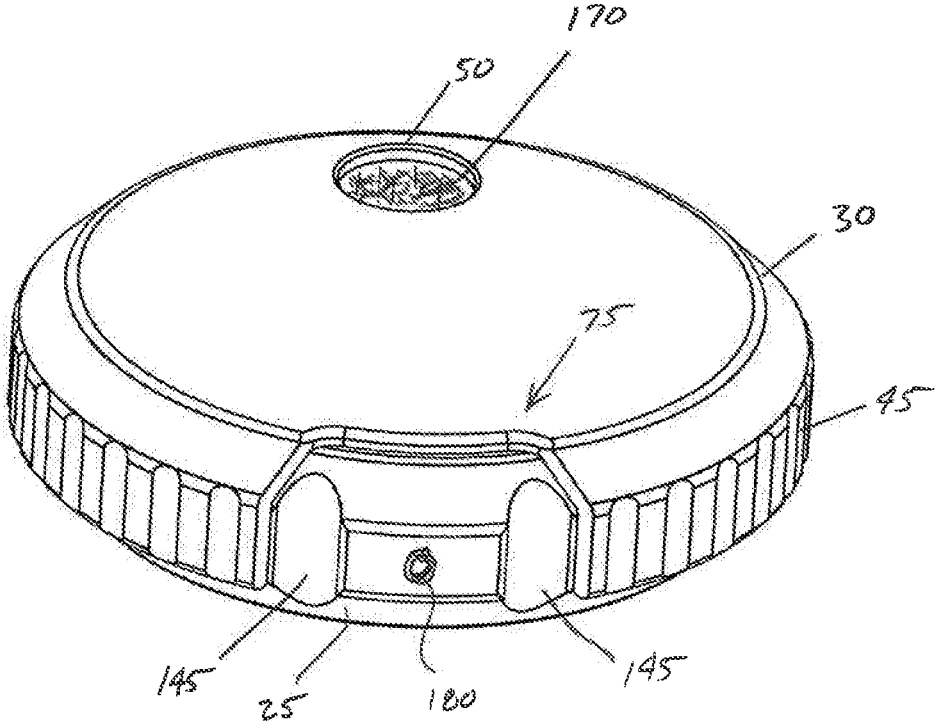
FIG. 8 is a top perspective view of the smoke dispenser assembly shown in FIG. 1 and oriented in a ready for use configuration.
Figure 9:
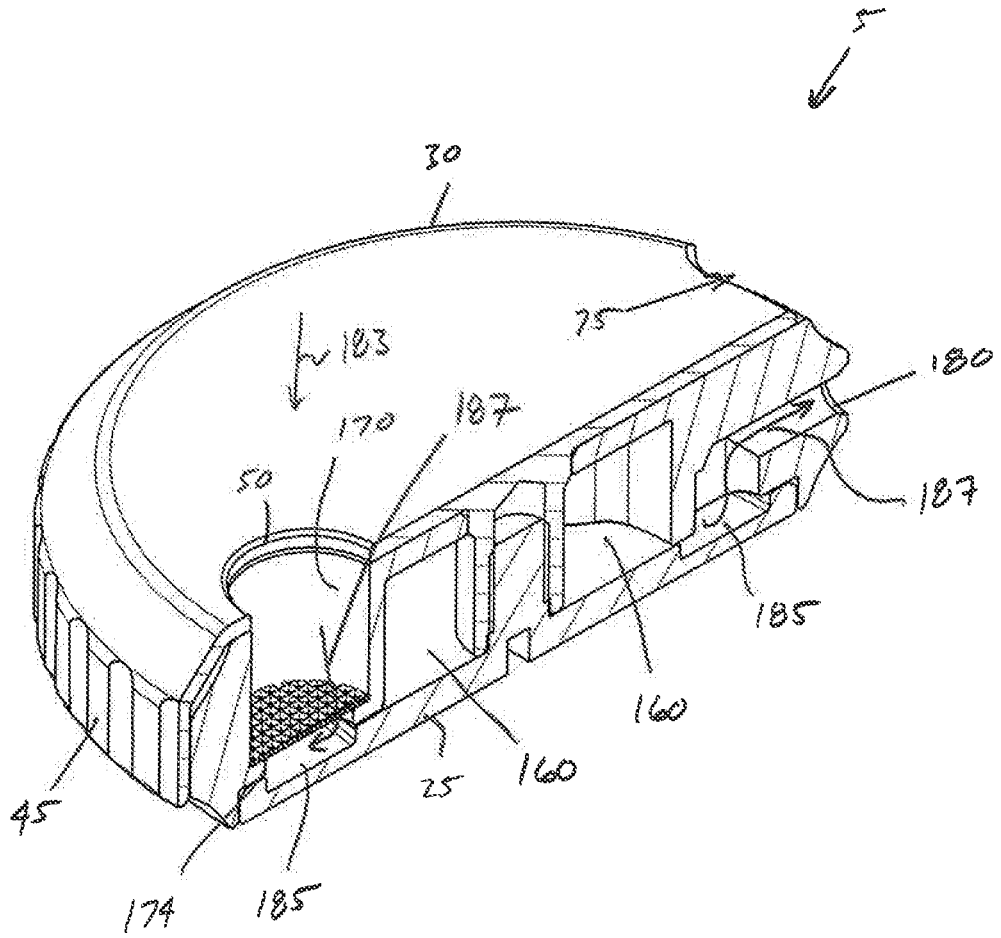
FIG. 9 is a cross section view similar to FIG. 5 and shows an "open" or ready for use configuration of the smoke dispenser assembly.
Figure 12:
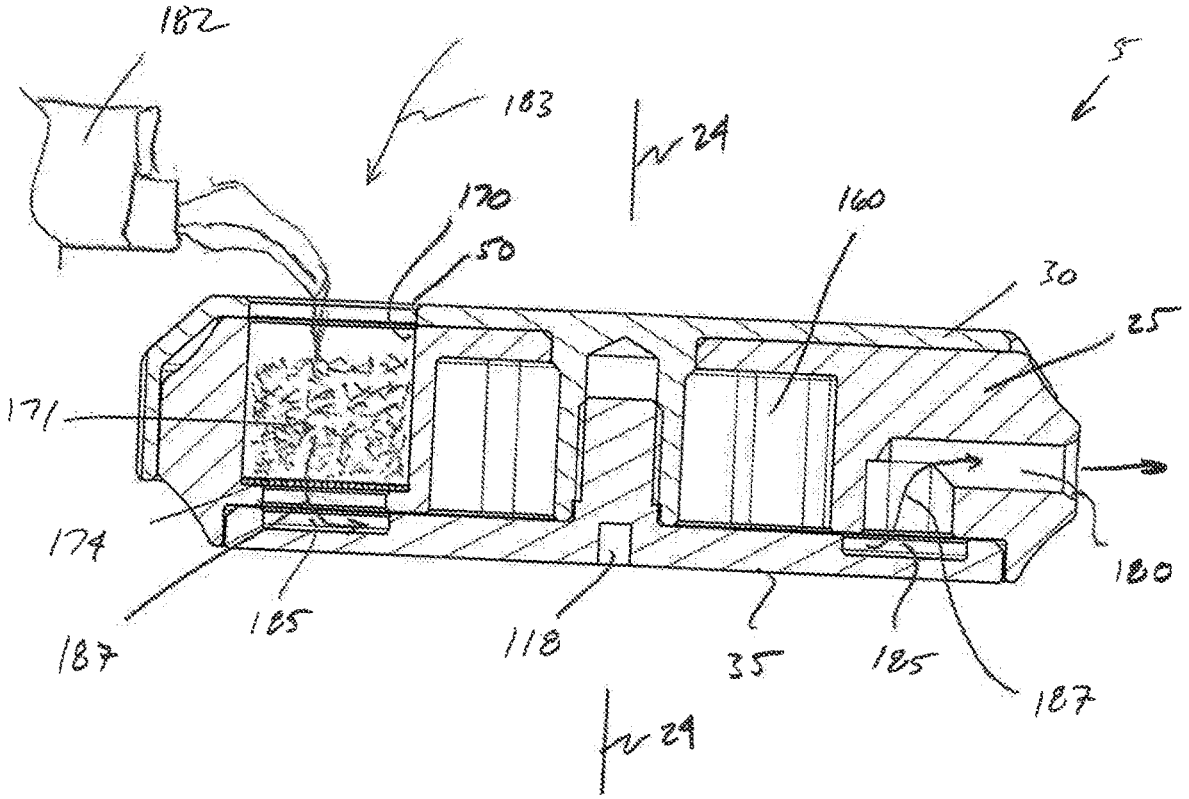
FIG. 12 is an elevation cross section view of the smoke delivery assembly shown in FIG. 1 wherein the assembly is oriented for use to combust a smokeable media and deliver the fire effluent to a user.

When assembled, receptacle 25 is axially rotatable relative to cover 30, and possibly housing 20 and/or base 35 depending upon the manner of construction employed, about axis 24 that extends through a radially center of receptacle 25, housing 20, base 35, and/or cover 30, between a plurality of discrete rotational positions relative to cover 30. During rotational cooperation of receptacle 25 relative to cover 30, smoking assembly 5 achieves a plurality of "open" or first positions as shown in FIGS. 8, 9, and 12 and one or more "closed" or stowable second positions. As used herein, each "open" rotational position is associated with defining a smoking path between each discrete aperture 170 of receptacle 25 and a respective primary smoke channel 180 and each "closed" rotational position is associated with obstructing the smoking passage. The respective "open" or configured for use orientation is readily evident upon visual inspection of assembly 5 via the observability of both an exposed primary smoke channel 180 and the rotational alignment of aperture 50 defined by cover 30 with a respective combustion aperture 170. It should be appreciated that assembly 5 is further capable of being stowed without detracting from the state of unconsumed smokeable media if cover 30 is left aligned with a combustion aperture 170 left in an empty condition and/or whose contents have been previously consumed.

As shown in FIGS. 8, 9, and 12, when oriented in a respective rotational first position, the cover 30 is rotated so that the cover face aperture 50 is located and positioned above one of the combustion or media containing apertures 170. The media containing aperture 170 is therefore in fluid communication with the outside environment, as well as the primary and secondary smoke channels 180, 185. Referring to FIGS. 1, 5, 6, and 10, when oriented in a respective second relative position or orientation, the cover 30 is rotated to a respective rotational position such that each of the combustion apertures 170 is preferably obstructed or otherwise disposed behind cover 30. That is, in a preferred embodiment, when receptacle 25 is oriented relative to cover 30 in a "closed" relative rotational position, each of media containing aperture 170 are obscured from exposure to atmosphere via cover 30. It further appreciated that receptacle 25 and cover 30 could be configured to include only one aperture associated with the combustion process and being rotationally associated with one another such that the aperture of cover 30 overlies each of reservoirs 170 and that such a configuration would limit the ability of assembly 5 to contain a smokeable media within each of media containing aperture 170 as at least one reservoir would always be aligned with the aperture defined by cover 30. In a preferred embodiment as shown, the "closed" condition is also readily observable in that, when assembled, skirt or sidewall 45 of cover 30 overlies each of smoke passages 180 defined by receptacle 25 and aperture 50 defined by cover 30 overlies top receptacle face 130 or is not otherwise aligned with a respective media containing aperture 170.

It is further appreciated that receptacle 25 could alternatively be constructed in a manner wherein at least one of reservoirs or media apertures 170 is solid or otherwise does not define a reservoir 170. Use of assembly 5 constructed in such a manner would require the user to rotate cover 30 relative to receptacle 25 several rotational positions during each use of assembly 5 until a rotational position is achieved wherein the aperture 50 defined by cover 30 is aligned with a reservoir 170 that includes a dose of smokeable media while maintaining the containment and isolation of any remaining doses of smokeable media from atmosphere and the fluid flow path associated with the smoking operation. When provided in the manner shown in drawings, is should be appreciated that none of combustion apertures 170 are in fluid communication with atmosphere or an outside environment when cover 30 is oriented in the "closed" position associated with the radial positioning of the perforation or hole formed in cover 30 at radial locations between adjacent media containing apertures 170.

Figure 10:
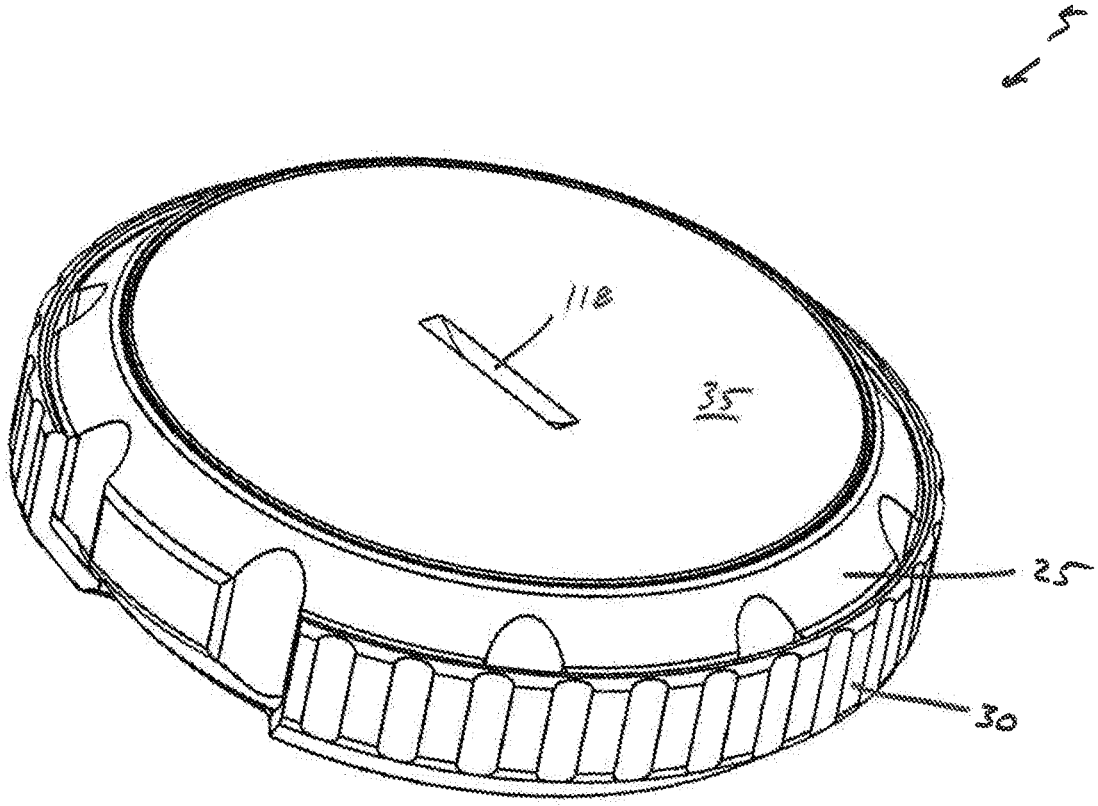
FIG. 10 is a bottom perspective view of the assembled smoke dispenser assembly shown in FIG. 1.
Figure 11:
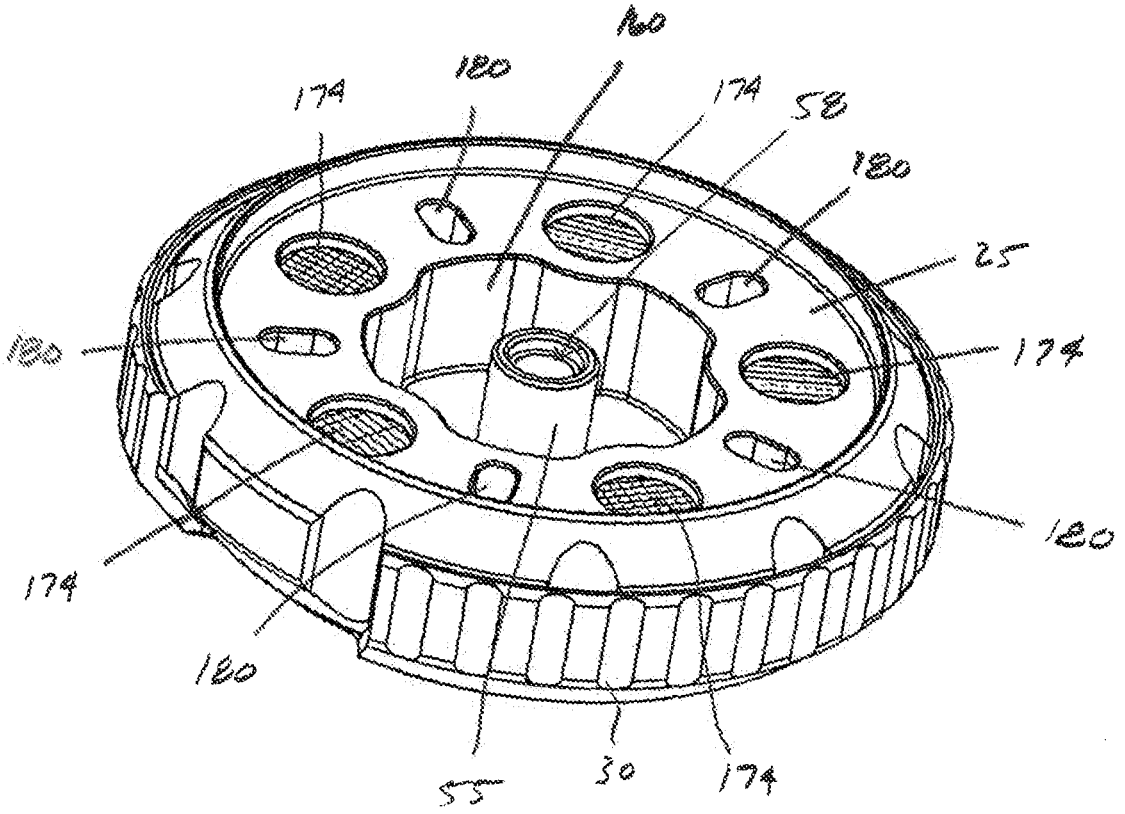
FIG. 11 is a view similar to FIG. 10 and shows a base of the assembly removed therefrom.

During use of smoke delivery assembly 5, smokeable media 171 (FIG. 7) is placed in one or more of combustion apertures 170, as illustrated in FIG. 7 and cover 30 is oriented relative to receptacle 25 such that cover aperture 50 is aligned with a respective one of media apertures 170 as shown in FIG. 8. Examples of smokeable media include, and are not limited to, *cannabis*, tobacco, herbal blends, etc. Media may be loaded into each combustion aperture 170 by dissociation of housing 20, or more specifically cover 30, from receptacle 25 or by placing the smoke dispenser assembly 5 in one or more of the discrete first orientation or respective "open" positions and placing the desired media into one or more of discrete combustion apertures 170 through aperture 50 defined by cover 30 and via relative rotation of cover 30 relative to receptacle 25. Alternatively, for some user's, loading of receptacle 25 may be more expeditious with the removal of one or both of cover 30 and base 35 from receptacle 25 such that media may be placed within the desired combustion apertures 170 and subsequent reassociation of cover 30 and/or base 35 in an operable association with receptacle 25. Referring to FIGS. 10 and 11, slot 118 associated with base 35 can be used to facilitate efficient rotational disengagement of the threadable association between cover 30 and base 35 as disclosed above. Further, such separation facilitates access to any smokeable media 171 that may have been previously deposited in storage cavity 160 defined by receptacle 25.

Once media has been loaded into the smoke delivery assembly 5, and more specifically one or more of the discrete media apertures 170, the smoke delivery assembly 5 may be rotated so that it is in the first or in-use position. The series of grip channels 70 associated with the skirt or the cover sidewall grip section 65 and the series of receptacle grooves 145 assists users of smoke delivery assembly 5 to more easily grip the cover 30 and receptable 25 to effectuate the relative rotation therebetween such that receptacle 25 and cover 30 are rotationally moveable between respective first and second relative "open" and "closed" positions relative to the discrete reservoirs 170 and/or vice versa. Preferably, such operation does not adversely affect the relative association of cover 30 and base 35 during use of assembly 5.

Referring to FIG. 12, after rotating the smoke delivery assembly 5 to a respective first position, a combustion source 182, such as lighter, match, or the like, can be disposed proximate the aperture 50 formed by cover 30 and aligned with a respective reservoir 170 to ignite the media 171 within a respective discrete "open" combustion aperture 170. Placement of the user's lips over the exposed one of the primary smoke channels 180 and inhalation draws ambient air, indicated by arrow 183, and the heat associated with operation of combustion source 182 into and through the media 171 creating combustion thereof. Referring to FIGS. 9 and 12, passage of ambient airflows 183 into and through the media 171 caused by user inhalation draws the products associated with combustion of the discrete dose of media 171, indicated by arrows 187, through the "open" reservoir 170, into the secondary smoke channel 185, and is communicated to the user via the respective primary smoke channels 180. As disclosed above, it is appreciated that the volume defined by discrete reservoirs 170, the volume of media disposed therein, the intensity, and/or the duration of the inhalation process can be adjusted to manipulate a dose of the combustion products 187 that is communicated to the user during the smoking process.

Upon completion of a desired smoking activity and/or satiation relative to an amount of dose communicated to the user such that the user desires to terminate the smoking activity, cover 30 can be rotated relative to receptacle 25 such that receptacle 25 and cover 30 attain a "closed" or second relative position wherein aperture 50 of cover 30 no longer overlies or is aligned with a reservoir 170 that contains a usable amount of smokeable media. As disclosed above, assembly 5 may achieve a "closed" configuration wherein aperture 50 is disposed over an empty reservoir 170 although it is preferred that cover 30 achieve a "closed" or second orientation wherein aperture 50 of cover 30 is obstructed by the body or surface 130 defined by receptacle 25. Such a consideration mitigates spillage of unconsumed media associated with yet to be fired reservoirs or apertures 170 and prevents spillage of any residual smoking media 171 associated with any recently used or previously combusted reservoirs or apertures 170 which may be intended for later use or residue that may be left after a full combustion operation. Such considerations allow for tidy and secure stowage of assembly 5 and in a manner that maintains the integrity of any smokeable media 171 that remains associated therewith. In addition to the second position of the smoke delivery assembly 5 ensuring no media waste or spoilage, the "closed" or second position associated with the orientation of cover 30 relative to receptacle 25 of smoke delivery assembly 5 preferably ensures that no air, or more specifically oxygen, reaches any remaining media within any of combustion apertures 170. Accordingly, the "closed" configuration of assembly 5 further acts to extinguish the combustion process associated with any media, embers, or residue left within recently combusted apertures 170.

As alluded to above and turning to FIGS. 10 and 11, smoke delivery assembly 5 can be further used to store additional media 171 in the storage cavity 160 of the receptacle 25. In order to access the storage cavity 160, the base 35 can be selectively disengaged from the cover 30 and/or receptacle 25. To disengage the base 35, an object such as, but not limited to, a screwdriver or other driving tool, such as a coin, may be inserted into the slot 118 of base 35 and rotated relative to cover 30. Once the first and second sets of threads 57, 110 have been disengaged or operatively dissociated from one another, the base 35 and/or cover 30 may be removed from receptacle 25 thereby exposing cavity 160 and the contents thereof. Media can then be placed within, or removed therefrom depending upon the condition thereof, to or from storage cavity 160 before reassembly of smoke delivery assembly 5 or association of base 35 and cover 30 in a generally flanking orientation relative to receptacle 25. When media is removed from storage cavity 160, the removed media can then be associated with discrete apertures 170 effectively "repacking" assembly 5 or otherwise configuring assembly 5 for subsequent use as a smoking appliance. When the cover 30 is replaced and selectively engaged with the base 35, the base platform 95 is disposed adjacent to and abuts the receptacle lip 168 thereby preferably ensuring that no media spills from within the storage cavity 160 during reassembly of assembly 5 and/or during reloading of storage cavity 160.

Referring back to FIG. 12, smoke delivery assembly 5 can also be easily cleaned by using a lighter or other heat or combustion source 182 to sterilize the consumption apertures 170 as well as incinerate any residual residue associated with previous use of assembly 5. Further, the ability to separate receptacle 25, cover 30, and base 35 from one another facilitates further cleaning assembly 5 when desired. That is, providing access to the discrete inlets and outlets associated with each primary smoke channel 180 and the surfaces associated with defining secondary smoke channel 185 allows the user to conveniently remove any residue that may be generated during use of assembly 5 to maintain the desired operation thereof and to provide smoking events unpolluted by residues associated with previous smoking events. Smoke delivery assembly 5 provides a discrete, convenient, and highly portable assembly for transporting and providing multiple discretely fireable doses of smokeable media. Assembly 5 further provides a multiple dose smoking appliance that is configured to mitigate both spillage and spoilage of any smokeable media 171 associated therewith.

Further, the invention may be implemented in a variety of configurations, using certain features or aspects of the embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter of the appending claims.

I claim:

1. A reusable smoking device assembly comprising:

a receptacle;

a plurality of primary smoke channels and a plurality of reservoirs defined by the receptacle and wherein each of the plurality of reservoirs is configured to contain a smokeable media;

a cover attached to the receptacle such that the cover is rotatable relative thereto; and an aperture defined by the cover and oriented to be aligned with a respective one of the plurality of reservoirs upon rotation of the cover relative to the receptacle and to facilitate combustion of the smokeable media disposed in a respective one of the plurality of reservoirs that is aligned with the aperture when a heat source is disposed proximate the aperture to allow smoke to be communicated to a user from one of the primary smoke channels and such that the cover prevents user access to a terminal end of the plurality of primary smoke channels defined by the receptacle when the aperture defined by the cover is rotationally offset from the plurality of reservoirs.

2. The reusable smoking device assembly of claim 1 further comprising a base constructed to cooperate with the receptacle and the cover such that the base and the cover generally flank the receptacle.

3. The reusable smoking device assembly of claim 2 wherein each primary smoke channel extends in a radial direction through the receptacle and is in fluid communication with at least one secondary smoke channel that is formed between the base and the receptacle.

4. The reusable smoking device assembly of claim 2 wherein the base and the cover are connected to one another and define a housing and the receptacle is rotatable relative to the housing.

5. The reusable smoking device assembly of claim 2 wherein at least one of the cover and the base includes a skirt that extends in a direction aligned with an axis of rotation between the cover and the receptacle along an outward directed radial edge of the receptacle.

6. The reusable smoking device assembly of claim 1 wherein the plurality of reservoirs defined by the receptacle and the aperture defined by the cover are oriented relative to one another such that the aperture of the cover can be disposed between adjacent ones of the plurality of reservoirs without overlying a footprint of either of the adjacent ones of the plurality of reservoirs.

7. The reusable smoking device assembly of claim 1 wherein the cover rotationally cooperates with the receptacle such that the cover and the receptacle can achieve a plurality of first orientations wherein the aperture defined by the cover overlies respective ones of the plurality of reservoirs and a plurality of second orientations wherein the cover overlies each of the plurality of reservoirs.

8. The reusable smoking device assembly of claim 1 further comprising a storage cavity defined by the receptacle and that is disposed radially inboard of the plurality of reservoirs.

9. An assembly for containing multiple independently combustible doses of a smokeable media, the assembly comprising:

a cylinder;

a plurality of combustion chambers defined by the cylinder and that are offset in a circumferential direction relative to one another;

a housing that removeably cooperates with the cylinder such that the housing and the cylinder are rotatable relative to one another about an axis;

a skirt defined by the housing that overlaps an outwardly directed radial edge of the cylinder and having a cutout formed therein;

an aperture formed through the housing and oriented to be selectively aligned with the plurality of combustion chambers; and a smoke passage having a first portion that is defined by cooperation of the housing with the cylinder and a second portion that extends radially through the cylinder, the smoke passage being formed to facilitate combustion of a smokeable media disposed in a respective one of the plurality of combustion chambers that is aligned with the aperture formed through the housing and such that the cutout is oriented to be aligned with a terminal end of the second portion of the smoke passage when the aperture of the housing is rotationally aligned with a respective one of the plurality of combustion chambers.

10. The assembly of claim 9 wherein the housing is further defined by a cover and a base that cooperate with one another and are disposed proximate opposite opposing axial ends of the cylinder when engaged therewith.

11. The assembly of claim 10 wherein the first portion of the smoke passage is formed between the base and the cylinder.

12. The assembly of claim 9 further comprising a media storage cavity defined by the cylinder wherein the media storage cavity is isolated from the smoke passage when the cylinder is engaged with the housing.

13. The assembly of claim 9 further comprising a screen disposed in each of the plurality of combustion chambers and oriented to maintain isolation of the smokeable media from the smoke passage.

14. The assembly of claim 9 wherein an outward radial edge of the housing includes a grip section defined by a plurality of grip channels.

15. A method of forming a smoke dispenser assembly, the method comprising:

providing a receptacle that defines a plurality of combustion apertures;

providing a housing that rotationally cooperates with the receptacle;

forming an opening through the housing and orienting the opening relative to the housing such that at least a portion of the opening can generally overlie a discrete one of the plurality of combustion apertures during relative rotation between the receptacle and the housing;

defining a combustion and smoke passage that extends through the housing and the receptacle and allows combustion of a smokeable media disposed in the discrete one of the plurality of combustion apertures and drawing of smoke generated by combustion of the smokeable media through the receptacle to a user; and connecting the receptacle to the housing such that each of the plurality of combustion apertures and a terminal end of the combustion and smoke passage are isolated from atmosphere when the opening of the housing is rotationally offset from any of the combustion apertures defined by the receptacle.

16. The method of claim 15 further comprising forming the housing and the receptacle such that rotating the housing relative to the receptacle allows the opening formed through the housing to be aligned with another of the plurality of combustion apertures.

17. The method of claim 16 further comprising forming the housing and the receptacle such that the housing isolates each of the plurality of combustion apertures from atmosphere when the opening is disposed between adjacent ones of the plurality of combustion apertures.

18. The method of claim 15 further comprising forming the housing as a cover and a base that removeably cooperate with one another such that the receptacle is disposed between the cover and the base when assembled.

* * * * *